United States Patent [19]

Stroup

[11] Patent Number: 4,839,950

[45] Date of Patent: Jun. 20, 1989

[54] METHOD FOR MAKING A TUBE AND FIN HEAT EXCHANGER

[75] Inventor: Steven L. Stroup, Bluffton, Ind.

[73] Assignee: Crown Unlimited Machine, Incorporated, Bluffton, Ind.

[21] Appl. No.: 162,013

[22] Filed: Feb. 29, 1988

Related U.S. Application Data

[62] Division of Ser. No. 52,689, May 20, 1987, Pat. No. 4,780,955.

[51] Int. Cl.[4] ..... B21D 53/08

[52] U.S. Cl. ..... 29/157.3 C; 29/157.3 B; 29/523; 29/727

[58] Field of Search ..... 29/33 G, 33 T, 157.3 B, 29/157.3 C, 464, 523, 727; 72/407; 269/43

[56] References Cited

U.S. PATENT DOCUMENTS

| | | | |
|---|---|---|---|
| 3,688,533 | 9/1972 | Ames | 29/523 X |
| 4,597,171 | 7/1986 | Kitayama et al. | 29/727 |
| 4,766,667 | 8/1988 | Gray | 29/157.3 C X |

*Primary Examiner*—P. W. Echols
*Assistant Examiner*—Andrew E. Rawlins
*Attorney, Agent, or Firm*—Pearne, Gordon, McCoy & Granger

[57] ABSTRACT

An improved tube and fin heat exchanger and a method and apparatus for making the same is disclosed. The heat exchanger includes spaced end sheets and a stack of plate fins positioned therebetween. Hairpin tubes extend through the end plates and the stack of fins. The tubes are initially sized to loosely fit through the end sheets and fins and are expanded into tight heat exchange engagement therewith during manufacture. The end sheets are accurately positioned a fixed distance apart by a method and apparatus in which the end sheets are held a fixed distance apart during the expansion of the tubes. The bent ends of the hairpin tubes are moved upwardly through the adjacent end sheet and the fins ahead of the expansion bullets to compensate for the shortening of the tubes created by the expansion operation. In one embodiment, piston and cylinder actuators supply a force on the bent ends of the tubes which substantially balances the axial force produced by the expansion bullets and prevents distortion of the remote end sheet. In a second embodiment, a mechanical drive is provided to move the bent ends of the hairpins in response to movement of the slide which carries the expansion bullets.

4 Claims, 3 Drawing Sheets

METHOD FOR MAKING A TUBE AND FIN HEAT EXCHANGER

This is a division of application Ser. No. 052,689 filed May 20, 1987, now U.S. Pat. No. 4,780,955, issued Nov. 1, 1988.

BACKGROUND OF THE INVENTION

This invention relates generally to tube and fin heat exchangers, and more particularly to a novel and improved dimensionally accurate tube and fin heat exchanger and to a novel and improved method and apparatus for producing such heat exchangers.

PRIOR ART

Tube and fin heat exchangers are often produced by expanding the tubes into tight heat exchange contact with fins and end sheets. Generally, the tubes are bent through 180 degrees, and are usually referred to as "hairpins." Initially, the hairpins are assembled with a loose fit through the end sheets and the collars of the plate fins positioned between end sheets. When loosely assembled, the fin collars engage the adjacent collars and adjacent end sheets so that the end sheets are spaced apart a distance equal to the sum of the lengths of the collars. Since the lengths of the collars vary within a tolerance range, the initial spacing between the end sheets varies even when a predetermined number of fins are used. Such loosely assembled units are then positioned in a support fixture or nest, and rods having enlarged ends, or "bullets," are moved axially into the tubes from the open end thereof to expand the tubes so that they engage the end sheets and the fin collars with an interference fit to provide good heat exchange contact.

As the bullets move along the tubes and expand the tubes to a larger diameter, the tubes shrink axially. Usually such shrinkage amounts to about 3% of the tube length. In the past, the general practice has been to axially support the hairpins at the bent end and the adjacent end sheet as the bullets move along the tubes. The opposite end sheet has been allowed to float or rest on the stack of fins. As the bullets enter the open end of the tube, they first pass through the adjacent end sheet and lock such end sheet with respect to the adjacent portion of the tube.

For convenience herein, the end sheet adjacent to the open ends of the tubes will be referred to as the "top end sheet," and the end sheet adjacent to the bent ends of the tubes will be referred to as the "bottom end sheet." However, such designation of the end sheet is not intended to be limiting with respect to the orientation of the heat exchanger with respect to the horizontal during its manufacture or during its final use.

Because the bullets pass the upper end sheet during the initial portion of their movement along the length of the tubes, the upper end sheet is locked with respect to the tube prior to any substantial amount of axial shrinkage of the tubes caused by the expanding operation. Therefore, as the bullet continues to move toward the supported opposite end of the tubes, the length of the tubes continues to shrink and the top end sheet moves toward the opposite or bottom end sheet. This results in a decrease in the length of the heat exchanger by about 3% of its initial length. Such decrease in the length of the heat exchanger causes compacting of the collars and produces axial stresses in the tubes.

In the past, the practice has been to size the length of the loosely assembled unit about 3% greater than the desired final size. For example, if the final length of the heat exchanger between the end sheets is desired to be 100 inches, the practice has been to size the loosely assembled unit so that the initial spacing between the end sheets is about 103 inches.

As the tubes are expanded and shrink axially, the dimension between the end sheets is reduced and approaches the desired 100-inch spacing. Usually, however, such a method of manufacture results in a relatively large tolerance range, and the finished heat exchangers have provided a tolerance variation in the spacing between the end sheets of about ≅0.5%. Consequently, in such 100-inch unit, the finished units have provided a dimensional spacing between the end sheets varying between 99.5 inches and 100.5 inches.

In practice, therefore, the mounting systems for the finished heat exchangers have usually been structured to accommodate this relatively wide dimensional tolerance range.

SUMMARY OF THE INVENTION

In accordance with the present invention, a tube and fin heat exchanger is produced so that the desired spacing between the end sheets is accurately maintained to very close tolerances. Such dimensional control is provided by accurately positioning the end sheets of the loosely assembled unit the desired distance apart.

In order to ensure that such desired spacing is accurately maintained, the stack of fins is sized so that clearance is provided between the stack of fins and the upper end sheet. The tubes are then expanded and, while the tubes are expanded, the bent ends of the hairpins are supported in a receiver which moves toward the open end of the tubes through a distance equal to the amount of tube shrinkage. Therefore, as the bullets move along the tubes and progressively cause the tubes to be shortened, the tube material feeds past the lower end sheet and past the fins ahead of the bullets and the two end sheets remain a fixed distance apart. Further, since the tube material is supplied to the zone where expansion is occurring, the stack of fins is not compressed and residual axial stresses are not created in the tubes. At the end of their stroke, the bullets pass through the lower end sheet and lock the lower end sheet with respect to the tubes, resulting in a unit in which there is substantially no variation existing in the spacing between the two end sheets. Consequently, the finished heat exchanger can be mounted on associated equipment without requiring a mounting system which accommodates substantial dimensional tolerances.

Two embodiments of a tube expander in accordance with the present invention are illustrated. In the first embodiment, the receiver which supports the bent ends of the hairpins is connected to air cylinders which urge the receiver, and in turn the bent ends of the hairpins, in an upward direction toward the open ends of the tubes. As the bullets enter the tubes and move along the tubes, causing axial shrinkage of the hairpins, the receiver moves, and in effect feeds tube material up into the assembled unit. The force applied by the receiver on the ends of the hairpins is selected so that it substantially balances the forces applied to the tubes by the bullets. Consequently, the expanding forces applied to the tubes are substantially balanced and, insufficient force is applied to the fixed upper end sheet to cause any distortion thereof.

In a second embodiment, a mechanical system is provided in which the hairpin supporting receiver is mechanically moved by the machine slide in a direction opposite to the movement of the slide and the bullets through a distance equal to about 3% of the distance through which the bullets move. Here again, this embodiment provides a mechanism for moving tube material past the lower end sheet as the tube progressively shrinks and until the tube is actually locked to the lower end sheet.

With this invention, an improved dimensionally accurate tube and fin heat exchanger is provided, and a novel and improved method and apparatus for producing such heat exchanger is also provided.

These and other aspects of this invention are illustrated in the accompanying drawings, and are more fully described in the following specification.

DETAILED DESCRIPTION OF THE DRAWINGS

Figure 1:
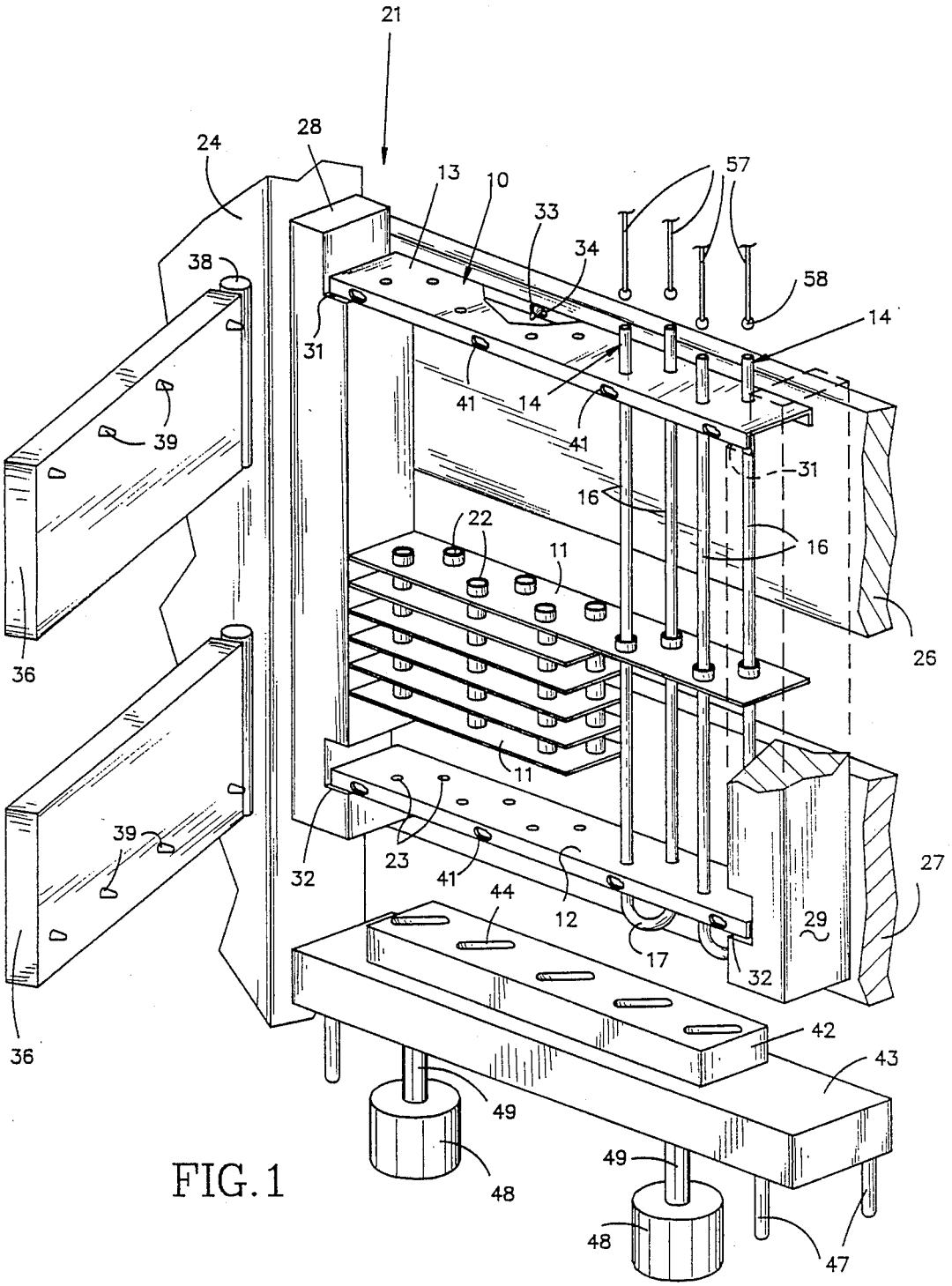
FIG. 1 is a fragmentary, perspective view, schematically illustrating the apparatus for expanding the tubes of a tube and fin heat exchanger, incorporating this invention, with substantial portions of a heat exchanger assembly removed and/or broken away to better illustrate the invention.

A typical fin and tube heat exchanger 10 in accordance with the present invention includes a plurality of plate fins 11 stacked between a lower channel-shaped end sheet 12 and an upper channel-shaped end sheet 13. A plurality of hairpin-shaped tubes 14 extend through the fins 11 and the end sheets 12 and 13. Each hairpin provides two straight legs 16 extending through the heat exchanger fins and end sheets which are joined at their lower end by a 180 degree bend 17.

The fins 11 provide integral collars 22 through which the hairpins are installed with a loose fit prior to expansion. The tubes are subsequently expanded to a larger diameter to provide an interference fit for good heat exchange contact between the tubes and fins. Although the open upper ends of the tube legs 16 are not interconnected in the drawings, a completed heat exchanger provides appropriate tube interconnections to complete a fluid circuit so that fluid can flow back and forth through the tubes and heat can be transferred between the fins and such fluid. The two end sheets 12 are spaced apart an accurately maintained distance A, as discussed in detail below.

FIG. 1 schematically illustrates a support fixture 21 in which a loosely assembled heat exchanger unit is supported while the tube legs 16 are expanded into tight engagement with collars 22 on the fins 11 through which they extend. For purposes of illustration, only portions of the loosely assembled heat exchanger unit are illustrated in FIG. 1, and various components are either eliminated or broken away to better illustrate the total structure and system.

The lower end sheet 12 is formed of sheet metal in the shape of a shallow channel, and is provided with a plurality of openings 23 arranged in a pattern to receive a plurality of hairpin tubes 14. In FIG. 1, only two tubes are actually illustrated, but is should be understood that additional tubes extend through the additional openings 23 to form a complete unit. Further, in a normal heat exchanger, the hairpin tubes are positioned closer together to provide greater heat exchange capacity, but are spread apart in the drawings to provide clarity of illustration.

Positioned above the lower sheet 12 is a stack of plate fins 11, each of which provides collars 22 aligned with the holes 23 in the end sheet 12, and through which the tube legs 16 extend. Here again, only portions of some individual plates are illustrated, and only a few of such fin plates are illustrated, but it should be understood that a full stack of plate fins extends between the lower end sheet 12 and the upper end sheet 13. These plate fins are spaced from each other by the integral collars 22 formed thereon.

The expander machine provides a frame 24 on which are mounted upper and lower, horizontally extending support plates 26 and 27, respectively. Mounted on the support plates 26 and 27 are two end support bars 28 and 29 which extend vertically and are laterally spaced to receive the loosely assembled heat exchanger unit therebetween. Each end plate is provided with a notch at its upper end providing a horizontally extending shelf surface 31 on which the ends of the upper end sheet 13 rest and are located. Similarly, the end plates are provided with notches at their lower ends which provide support shelves 32 for the lower end sheet 12.

Therefore, the two end sheets 12 and 13 are supported at their ends with a fixed spacing determined by the spacing of the shelves 31 and 32 formed in the end plates. In addition, support for the two end sheets is provided intermediate their ends by pins 33 mounted on the two support plates 26 and 27, and which extend through openings 34 formed in the adjacent sides of the associated end plates 12 and 13. In addition, a pair of doors 36 and 37 are hinged at 38 on the frame 24, and are provided with locating and support pins 39 positioned to extend through openings 41 in the end sheets when the doors are closed. Therefore, the pins 39 cooperate with the pins 33 to support the end sheets 12 and 13 along their length and operate to accurately position the end sheets prior to and during the expanding operation.

Positioned below the bends 17 in the hairpin tubes 14 is a receiver 42 carried by a receiver support plate 43. Forming the upper surface of the receiver 42 are cavities 44. These cavities are positioned and sized so that one cavity is provided for each bend and provide mating engagement with the associated bend 17. In FIG. 1, the receiver 42 is illustrated spaced down from the bends for purposes of illustration, but in its lowermost position engages the tube bends 17 to axially position and support the hairpins 14 when the loosely assembled unit is initially installed in the fixture 21.

The receiver support plate 43 is vertically movable relative to a fixed base plate 46, and is guided for vertical movement relative to the fixed base plate 46 by guide pins 47. Piston and cylinder actuators 48, also mounted on the base of the machine, provide piston rods 49 which are connected to the underside of the receiver support plate and, when the actuators 48 are pressurized, they create an upward force on the lower ends of the hairpins.

Figure 2:
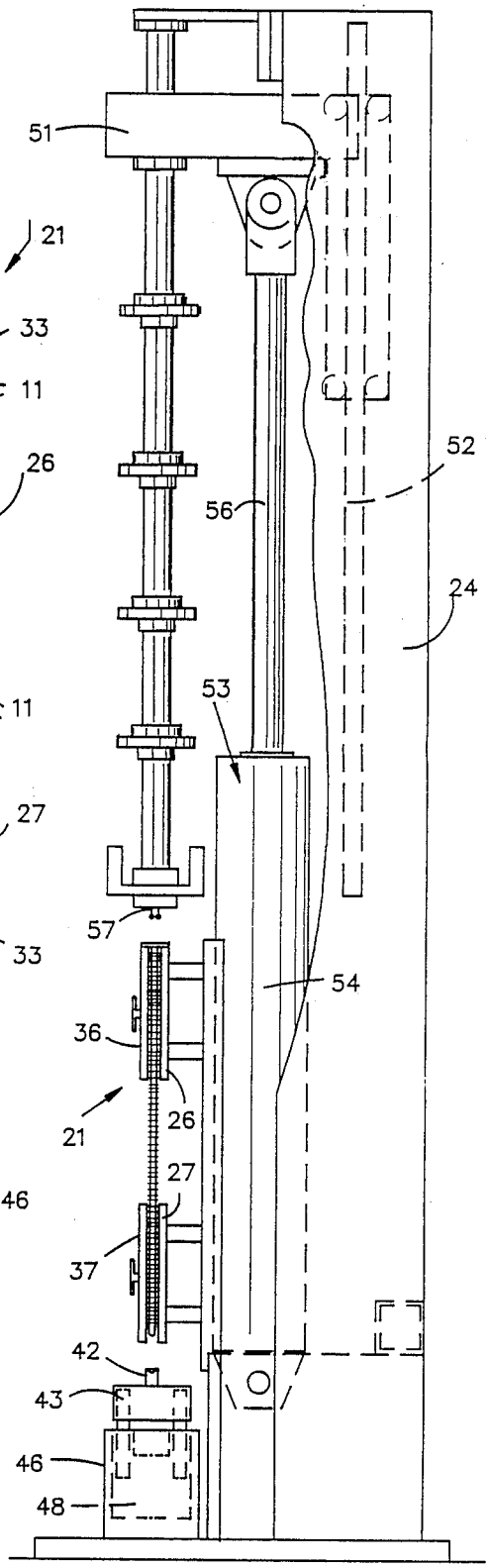
FIG. 2 is a side elevation, schematically illustrating the overall machine for producing heat exchangers, in which the dimensions of the finished exchangers are accurately maintained.

Referring to FIG. 2 the overall machine provides a slide 51 guided for vertical movement in the machine frame 24 along a track 52. A piston and cylinder actuator 53 provides a cylinder 54 connected at its lower end to the frame of the machine 24 and a piston 56 connected at its upper end to the slide 51. Such actuator operates to power the slide for vertical movement.

Figure 3:
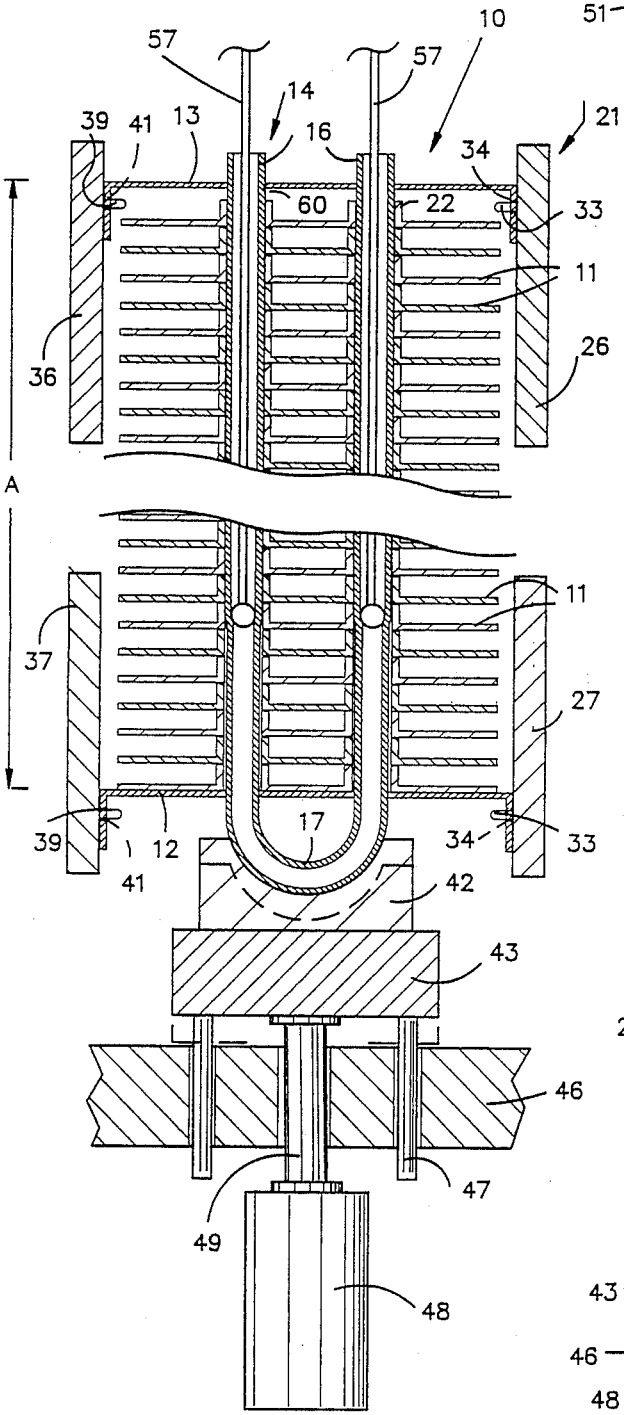
FIG. 3 is an enlarged, fragmentary, schematic section, schematically illustrating the operation of expanding the hairpin tubes.

Mounted on the slide 51 are a plurality of expander rods 57 having enlarged ends or bullets 58 sized to expand the associated tube legs 16 as they are moved down into the hairpins 14, as best illustrated in FIG. 3. For purposes of illustration, the rods 57 are illustrated at reduced diameter, but in practice are sized to provide a diameter closely approaching the diameter of the bullets 58. The usual guides 61 are provided to laterally support the expansion rods at intervals along their lengths so that they do not bend under the end loading required to drive the bullets down along the tube 16.

In operation, a unit is loosely assembled. However, the number of fin plates 11 is selected so that the height of the stack, determined by the total length of the collars 22, is slightly less than the desired spacing between the end sheets 12 and 13. This ensures that the stack of fins will not produce excessive spacing between the end sheets. Therefore, a clearance 60 exists between the uppermost collar 22 and the upper end sheet 13. The loosely assembled unit, comprising end sheets 12 and 13, a stack of plate fins 11, and hairpins 14, is then positioned in the fixture 21 of the expander, with the end sheet 12 accurately positioned by the shelves 32 and the end sheet accurately positioned by the shelves 31. The doors 36 and 37 are then closed, and the end sheets are also accurately positioned within the nest a fixed distance apart by the pins 33 and 39. The receiver is positioned in its lowermost position so that when the loosely assembled heat exchanger unit is positioned within the nest, the bent ends 17 extend into the associated cavities 44. This ensures proper longitudinal positioning of the hairpins for the commencement of the expanding operation.

The actuator 54 is then operated to move the slide 51 downwardly to lower the rods 57. This causes the bullets to enter the open ends of the tubes 16 and commence the expansion of such tubes.

As the bullets move down along the tubes, they first pass the upper end sheet 13 and lock such end sheet and the tubes together with an interference fit. The actuators 48 are pressurized at this point to provide an upward force on the tubes substantially equal to the downward force applied to the tubes by the bullets moving downwardly along the tubes. Consequently, the movement of the bullets down along the tubes does not produce sufficient forces on the upper end sheet to cause distortion thereof.

As the bullets continue to move down along the tubes, progressively expanding the tubes into tight engagement with the adjacent collars 22 of the fin plates, the tubes progressively shrink axially and are progressively shortened. As this occurs, the force of the actuators 48 on the receiver causes the receiver to raise up an amount equal to the shrinkage. This moves portions of the tubes adjacent to their lower ends up past the lower end sheet 12 and upwardly relative to the collars located below the bullets. Therefore, as the bullets move downwardly along the tubes, progressively locking the tubes in the collars 22, the receiver moves the bends 17 upwardly an amount equal to the amount of shrinkage. Because a loose fit exists between the collars ahead of the bullets and the lower end sheet 12, such upward movement past the loosely fitting collars and the lower end plate does not cause corresponding upward movement of the loosely fitting collars and end plate. Therefore, the vertical dimension of the heat exchanger remains constant and the spacing between the two end sheets also remains constant. Further, since tube material is supplied by the upward movement of the receiver to compensate for the tube shrinkage, the stack of fins is not compressed and residual axial stresses are not produced in the tubes or collars.

When the bullets have moved the full length of the tubes past the lower end sheet, locking the lower end sheet with respect to the tubes, the expansion operation is completed and the vertical dimension of the heat exchanger is accurately established. The actuators 48 are then depressurized, allowing the receiver to move back down to its lowermost position, and the actuator 54 operates to raise the slide 51, causing the bullets 58 to be retracted back out of the tubes. The doors 36 and 37 are then open and the completed heat exchanger is removed.

Figure 4:
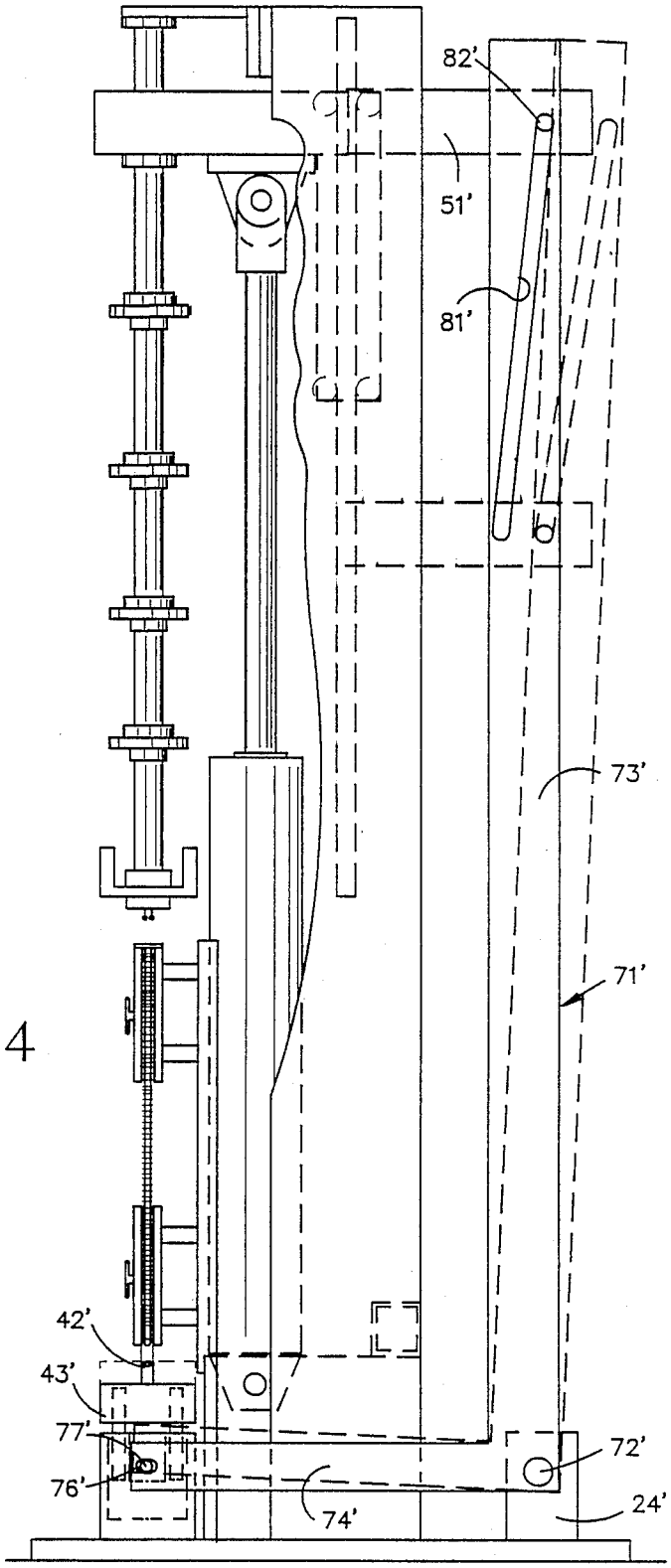
FIG. 4 is a schematic view of a mechanical mechanism for maintaining the dimensions of the heat exchanger in accordance with the second embodiment of this invention.

FIG. 4 illustrates a second embodiment in which a positive mechanical drive is provided to raise the receiver as the slide is lowered to cause expansion of the tubes. In this embodiment, similar reference numerals are used to designate similar parts, but a prime is added to indicate that reference is being made to the second embodiment.

In this embodiment, a right angle lever 71' is pivoted at 72' on the frame 24' of the machine. Such lever provides an upwardly extending arm 73' and a laterally extending arm 74'. The end of the arm 74' is provided with a slot 76' through which a pin 77' carried by the receiver support plate 43' extends. When the lever 71' is in the full-line position, the receiver is in its lowermost position. However, clockwise rotation of the lever 71' operates to raise the receiver support plate 43' and the receiver 42'.

The upwardly extending arm 73' is provided with an elongated cam opening 81' in which a cam follower 82' mounted on the slide 51' extends. The slot 81' is oriented so that as the slide 51' is lowered, causing the cam follower 82' to move down along the slot, the lever 71' is rotated in a clockwise direction through an angle, causing the receiver to be raised relative to the frame of the machine through a distance which is equal to about 3% of the distance through which the slide moves. In this embodiment, the slide 51', as it moves progressively down causing the tubes to be progressively expanded, mechanically produces progressive raising of the receiver through a distance equal to the amount of shrinkage occurring in the length of the tubes, and ensures that sufficient forces are not applied to the upper end sheet to cause distortion thereof. Therefore, in this embodiment, like the first embodiment, the spacing of the two end sheets 12 and 13 remains constant as the tubes are progressively expanded into tight engagement with the adjacent collars.

Because the heat exchanger in accordance with this invention is dimensionally accurate, the associated equipment in which the heat exchanger is ultimately used can be provided with a mounting structure that does not have to accommodate large dimensional tolerances. Further, because the stack of fins is not compressed during the expansion of the tubes, a more uniform locking is produced between the fin collars and the tubes extending therethrough. Additionally, since stack compression does not occur, residual axial stresses of any significant value are not present in the tubes or in the collars. The absence of such stresses tends to reduce stress-created corrosion and provide improved heat exchanger life.

Further, the apparatus for producing such dimensionally accurate heat exchangers is simple and reliable and, consequently, the cost and maintenance of the expander are not significantly increased.

Although the preferred embodiments of this invention have been shown and described, it should be understood that various modifications and rearrangements of the parts may be resorted to without departing from the scope of the invention as disclosed and claimed herein.

What is claimed is:

1. A method of producing heat exchangers having end sheets with fins stacked therebetween and tubes extending through said end sheets and fins expanded into tight engagement therewith, comprising loosely assembling said tubes through said end sheets and fins and thereafter progressively expanding said tubes from one end thereof causing tubes to expand into tight engagement with the end sheet adjacent to said one end of said tubes and thereafter progressively into tight engagement with said fins and the end sheet remote from said one end of said tubes, said progressive expansion of said tubes progressively causing shortening thereof, and supporting said end sheets a predetermined fixed distance apart during said progressive expansion of said tubes so that the spacing between the end sheets is unaffected by said expansion and shortening of said tubes and said end sheets are spaced apart said predetermined distance after said tubes are expanded.

2. A method as set forth in claim 1, including applying a force to the end of said tubes opposite said one end which substantially balances the forces applied to said tubes by said expansion rods so that the forces applied to said end sheets do not produce distortion thereof.

3. A method as set forth in claim 1, including moving portions of said tubes remote from said one end through the adjacent end sheet through a distance substantially equal to the amount said tubes are shortened.

4. A method of producing heat exchangers having end sheets with fins stacked therebetween and tubes extending through said end sheets and fins expanded into tight engagement therewith, comprising loosely assembling said tubes through said end sheets and fins, engaging said end sheets with supports which maintain said end sheets a predetermined fixed distance apart, and thereafter progressively expanding said tubes from one end thereof causing said tubes to expand into tight engagement with the end sheet adjacent to said one end of said tubes and thereafter progressively into tight engagement with said fins and the end sheet remote from said one end of said tubes, said progressive expansion of said tubes causing shortening thereof, and moving the end of said tubes remote from said one end of said tubes relative to said end sheet remote from said one end of said tubes by a distance substantially equal to the amount said tubes shorten to maintain said end sheets said predetermined fixed distance apart during the expansion of said tubes.

* * * * *